US007654110B2

(12) United States Patent
Azar

(10) Patent No.: US 7,654,110 B2
(45) Date of Patent: Feb. 2, 2010

(54) SPLIT PIECE OF JEWELRY

(76) Inventor: Petra Azar, 6020 Lower Mountain Rd., New Hope, PA (US) 18938

( * ) Notice: Subject to any disclaimer, the term of this patent is extended or adjusted under 35 U.S.C. 154(b) by 0 days.

(21) Appl. No.: 11/946,557

(22) Filed: Nov. 28, 2007

(65) Prior Publication Data

US 2008/0066267 A1 Mar. 20, 2008

Related U.S. Application Data

(63) Continuation-in-part of application No. 11/617,956, filed on Dec. 29, 2006, now abandoned, which is a continuation-in-part of application No. 11/225,566, filed on Sep. 13, 2005, now abandoned.

(51) Int. Cl.
*A44C 5/00* (2006.01)

(52) U.S. Cl. ..... 63/3.1; 63/3; 63/900

(58) Field of Classification Search ..... None
See application file for complete search history.

(56) References Cited

U.S. PATENT DOCUMENTS 2,615,227 A * 10/1952 Hornik ..... 24/303
4,901,405 A * 2/1990 Grover et al. ..... 24/303
5,050,276 A * 9/1991 Pemberton ..... 24/303
5,311,647 A * 5/1994 Levy ..... 24/303
5,367,891 A * 11/1994 Furuyama ..... 63/29.2
6,050,695 A * 4/2000 Fromm ..... 362/104
6,481,065 B2 * 11/2002 Cogdill ..... 24/303
6,981,391 B2 * 1/2006 Suzuki ..... 63/3.1
7,377,128 B1 * 5/2008 Zucker-Pinchoff ..... 63/3.1
2005/0148809 A1 * 7/2005 Delaney ..... 600/15

* cited by examiner

*Primary Examiner*—Victor Batson
*Assistant Examiner*—David C Reese
(74) *Attorney, Agent, or Firm*—Ursula B. Day; Henry M. Feiereisen

(57) ABSTRACT

A sculpted interconnected split piece of jewelry is connected in a variety of ways through magnets that are placed in recesses where the connection is invisible from the outside; in another embodiment a second connecting means is provided for connecting and stabilizing the piece of jewelry.

10 Claims, 14 Drawing Sheets

SPLIT PIECE OF JEWELRY

CROSS-REFERENCES TO RELATED APPLICATIONS

This application is a continuation-in-part of prior filed application Ser. No. 11/617,956 filed Dec. 29, 2006 now abandoned, which is a continuation-in-part of application Ser. No. 11/225,566, filed Sep. 13, 2005 and now abandoned.

BACKGROUND OF THE INVENTION

The present invention relates to an interconnected split medallion jewelry piece and in particular a piece that includes a jewelry design that is split in two ore more pieces whereby the pieces are reconnected by connecting means, the piece to be worn as a necklace, pendent, bracelet, belt buckle or any other type jewelry in which an ornamental, sculpted jewelry piece is made up of interconnected pieces for attachment and detachment from each other.

All types of jewelry are known in the prior art. Sculptured pieces are known in the prior art in form of three dimensional pieces, cameos and the like. Medallions and sculpted items can be made of all types of metal or may be carved from natural occurring material such as precious stones, semi-precious stones, shells or synthetic material. Another form of jewelry device comprises medallions in the form of coins which are placed into a frame and that are held within a frame by various means. These jewelry pieces are often formalized and do not allow free-flowing shapes to be included.

In the world of jewelry, which is often dictated by beauty and fashion, there is always the need for new designs, for example the way a necklace is designed often depends on certain technical functions such as the closure or how to connect a centerpiece of a necklace, for example a pendent to a chain. The sculpted split jewelry device of the present invention fulfills such a need by allowing for a significant change in appearance and function as compared to traditional pendant necklaces, as it eliminates the need for unsightly or unsafe clasps of the kind conventionally attached to the back of the chain and closed in the back of the neck. At the same time, the jewelry device according to the present invention allows the piece of jewelry to be made in any shape or size and to be attached at both ends of a chain of any thickness, shape or size as compared to the conventional pendant which is hung from a bail attached to a chain, which often dictates the shape or thickness or design of the chain. Thus, the jewelry piece of the present invention allows for endless design possibilities.

It would therefore be desirable and advantageous to provide a novel jewelry device of new and unknown design possibilities, improved versatility and beauty of the object due to the elimination of a bail and a back closure clasp. The device will allow the wearer much easier use due to the magnetic front closure as it eliminates the need for another person to assist with the back closure. If used as a belt or bracelet, the same ease of closure applies.

SUMMARY OF THE INVENTION

According to one aspect of the present invention, the device according to the present invention of an interconnected split medallion jewelry piece comprises at least two members forming a pendant, each member having a complementary portion, and wherein the members are provided with connecting means in one of at or proximate their complementary portion for connecting to and disconnecting from one another.

The connecting means are magnetic or any other type of connecting means including frictional connection means.

According to another aspect, the split medallion includes two members connected in a side by side relationship and for example worn parallel to the body of the wearer. This embodiment includes two or more magnets which firmly hold the two pieces together, or one single larger magnet is disposed at an entire length of the complementary portion. The side by side connection allows the pendant to be hung in a balanced position on the wearer.

"Medallion" in the context of the present invention is not used in the strict sense of the definition as a medal but indicates a wearable piece of jewelry having an obverse and a reverse side or being of random shape. It is further understood that in the context of the jewelry device as described herein, the term "sculpted" in addition to its normal meaning means also stamped or printed or decorated or plain.

The size of each member can be similar or completely different. For example, a full circle having a width of about 3 cm can be attached to a slim crescent moon of 5 mm in width for attachment to the side of the circle. This way, pave diamonds and gold could be easily combined. Thus, the requirement that the members are matched in size is eliminated. Materials can be combined in the most unusual ways such as rubber and steel with the result of obtaining a homogenous piece once the members are connected, reflecting that theme that two individuals become one.

In another advantageous embodiment, two large semi-precious stones of different color shape or size can be combined via the magnetic front closure. Each member can have a different shape, for example a triangle and a square made of different colors of the semi-precious stones. Once connected the jewelry device represent a harmonized piece of jewelry.

The magnetic connecting means can take on various embodiments. In one of the embodiments, magnets are received in recesses provided in each of the members, preferably in the complementary portion of each of the members. The magnets can also be covering the entire surface of the complementary portion of the member. In general, the magnets are magnetic pieces that are cylindrically shaped. The cylinders can have different length. Of course the magnets can also have a rectangular, square, oval shape and a variety of cross sections.

In another embodiment, in addition to the magnets, the members are provided with connecting means for stabilizing the connection of the magnets.

Such stabilizing means can be a tongue and groove type connection between the split medallion members. A different stabilizing means is realized by a pin or pins located at one of the members preferably at the complementary portion of the member for placing into a pin hole or holes located at the complementary portion of the other member. Variations of the pin and pin hole are such that each member is provided with a hole and a pin for connecting to the other member provided with a hole and a pin for interconnecting with that other member. The pin and hole system provides additional connectivity between the members and stability to the magnetic connection. This stabilization is desirable especially also for larger pieces, as the pin and hole connection prevents undesired movement of one of the members relative to the other and the members will be held flush against each other. The pin and hole connection can be in the same plane as the magnetic connection or can be in a different plane than the magnetic connection In a preferred embodiment, the pin and hole system is configured such that the pin and hole are oriented in different planes relative to the magnet to magnet connection. For example, when the magnet to magnet connection is along a vertical axis, where the two members are joining side by side, then the pin and hole system, while extending in horizontal direction, is oriented perpendicular to the vertical axis of the magnet to magnet connection. The pin and hole system can be arranged such that the pin portion is extending from the obverse side of the medallion or that it extends from the reverse side of the medallion, in each case received in the correspondingly oriented hole.

In another variation of the connection means and the stabilizing means, the perpendicular orientation can be reversed relative to the pin and hole system such that the central axis of the magnetic connection is extending perpendicular to a central axis of the pin and hole connection such that the pin and hole joining is taking place along the vertical axis and parallel to the wearer's body while the magnet to magnet connection is set up in the horizontal plane and extending from the obverse in direction to the reverse of the medallion.

It is understood that the pin and hole system also includes that the pin is initially not in a fixed position on the member but can be configured such that each member is provided with an opening which corresponds to an opening of desired shape in the other member as shown in the drawings, such that when pushing the members together have superposed openings through which a pin can be fed and fastened by press fit or other means. This variant also allows for a great multitude of different variations of the medallion especially when using decorative stones or gems for a center piece.

The recesses for the magnets can be placed at different locations at the device and in different planes since the medallion may have a depth dimension. In one variation, each of the complementary portion include a side wall facing the opposite side wall of the complementary portion and having at least one recess for placing a magnet therein, so that each magnet is sitting within the corresponding recess and wherein a center axis of the magnet is oriented horizontally relative to the medallion. In an exemplary embodiment, the magnets are received in the recess and are flush with the side wall of the complementary portion.

The recesses for the magnets can also be placed on a reverse side of the medallion, that is, the central axis of the recess are oriented in a plane transverse to the horizontal plane. In some cases the magnet is placed on the obverse side of the medallion. In each case, the pin and hole system can augment the magnetic connection. The pin and hole system, in addition to being a stabilizer for the magnetic connection can also be used without the magnets as a sole frictional closure for the pieces to be connected.

In a variation of incorporating the magnets into the split medallion jewelry piece, the recesses or pockets for the magnets can have a dimension larger than the magnets and at the mouth of the recess or the pocket can have a collar will prevent the escape of the magnet. Such a collar can be made by extending the walls of the pocket outwardly into a neck and bending the metal of the neck towards the mouth of the recess or pocket to form the collar. Alternatively, a separate collar can be placed at the mouth of the recess or pocket.

In one embodiment of the piece according to the present invention, the piece may be heart shaped so that the two members represent the two halves of the heart.

In another embodiment of the split medallion the stabilized connection between the members is similar to a "tongue and groove" type connection, wherein one member is provided with two magnets separated by a groove extending from the obverse side of the medallion in the direction of the reverse side of the medallion or in other words extending the entire thickness of the piece and the complementary member has correspondingly placed magnets separated by a protrusion (tongue) extending the same length as the groove. This arrangement of the connection is preferred when the medallion is made from precious or semi precious gem material. Gem material is for example quartz or onyx which and which can be harder than metal and harder to cut. The "tongue and groove" can be of various shapes such as for example semicircular, oval hexagonal, quadrilateral, conical and semi-heart shaped. Thus, the "tongue and groove" connection in addition to the magnetic connection is especially firm and not prone to open inadvertently.

In the heart shaped embodiment, a great variety of shapes are possible since the heart shape can take on a great variety of configurations. The heart shape can have the complementary portions meet along a linear line at the vertical center line of the heart. Furthermore, the complementary portion of the two heart halves can have a variety of shapes such as a zigzag shape or can be curvilinear or split diagonally. Any and all shapes whether abstract, geometric or figurative can be used.

In another embodiment of the device, each of the two members of the split medallion may be sculpted in the shape of a person's face and the two faces when connected are overlapping each other and appear in the shape of a heart or for that matter another shape. In that embodiment, the recess for the magnet is located on the reverse side of each of the members and the central axes of the magnets run transverse to the horizontal plane. However, the magnets can be placed in a variety of ways but should preferably be invisible at the viewing side.

For a firm connection of the two members, the magnets have to be of a suitable strength. For example using the device for a belt buckle requires a larger more powerful magnet, than with a device used as a necklace. Preferably, with a belt buckle, the additional frictional pin and hole system is applied, whereby the pin is frictionally inserted into the hole of the complementary member. Depending on the weight and size of the medallion with more than one magnetic connection, a firmer connection will be realized. The placement of the magnets into the recesses can be firm either by a frictional connection or by gluing the magnets into the recess. Any other connection which will hold the magnet firmly in the recess can also be employed. Floating magnets as aforedescribed can also be used.

Once the two members are connected by the magnetic connection, the connection will be invisible on the viewer. The pin and hole system, however it is oriented is also invisible. Of course it should be understood that the "pin and hole" system includes projections i.e. pins that are not necessarily round but are square or rectangular or other shape as well as the corresponding openings. One or more pins can be on one face wall of the complementary portion near one of the magnets or a pin and a hole are on one face wall of the complementary portion for engagement with the corresponding pin and hole on the face wall of the other complementary portion. The numbers of magnetic connections are dependent on the strength and the size of the magnets. Important is that the plus and minus magnets are aligned to each other so that the connection becomes firm. For example a magnet size of $\frac{3}{16} \times \frac{1}{16}$ inches might be a suitable size. However, the size depends on the size of the piece created. On a belt buckle the size of the recesses will be commensurate with the need for a suitably strong connection.

The recesses should be precisely aligned for the magnets to properly form a tight connection. The same applies to the pin and hole and the tongue and groove system. The pins and the holes have to be precisely matched for a firm connection. In the example with the medallion with the overlapping faces, the recesses for the magnets have to be located both on the reverse side and the obverse of the medallion, so they are not seen by the viewer even when the device is pulled apart. This is realized by making the recesses in the face that comes to be underneath the other face suitably deep, such that the magnetic force is able to penetrate the remaining wall metal from the recess of the device and has the power to connect with the complementary magnet. In a non-limiting example the remaining wall between the recess and the obverse side of the medallion might be 5 mm at an overall size of the sculpture of about 25-28 mm width and about 22 mm height. Of course the dimensions can be chosen in accordance with any desired size and the magnetic closure of both members with each other is applicable to all embodiments whatever their shape.

In the case where the magnet covers the entire side wall of the complementary portion of the members, the entire side wall becomes the recess in which the magnet is frictionally inserted. For better results, the magnet is additionally glued into the recess.

Another feature of the device according to the present invention is that the connected split jewelry device is attached to a chain, preferably at the outer lateral portions of the two members. In the case where the medallion is worn as a necklace, the interconnected split medallion acts as a convenient front closure of the device and thus eliminating the need for a clasp in the back of the chain and also eliminates the need for a bail, normally needed as a link between the pendant and the chain.

It is also within the scope of the invention that the split medallion jewelry device can be any combination of sculptural elements for example the head of a horse or pet and the face of a person, sport symbols, symbols of states, symbols of particular groups; There are endless varieties in which the device can be practiced with the underlying idea that the design is a metaphor for unity as it brings two separate entities together to form one unit by magnetic force.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
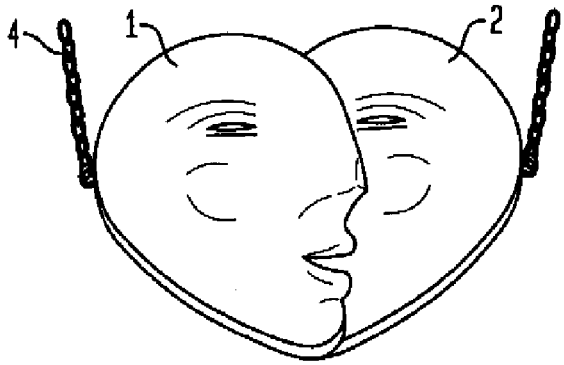
FIG. 1 is a front (obverse) view of an exemplary representation of an interconnected split medallion jewelry device according to the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 1A:
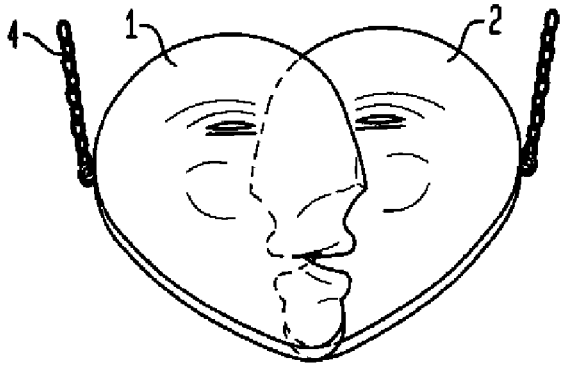
FIG. 1A is a front view showing the second member partially in broken lines.

Turning now to the drawing, and in particular to FIG. 1, there is shown an interconnected split medallion jewelry device with two members 1 and 2. The two members 1, 2 are shown as sculpted faces overlapping with each other and forming a heart shape. The overlap is seen in FIG. 1A as a broken line.

Figure 1B:
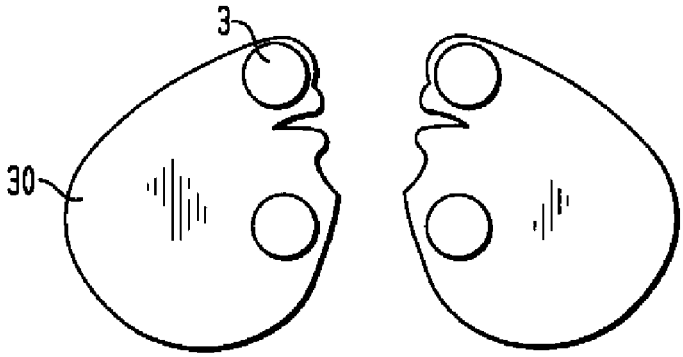
FIG. 1B is a view from the reverse side of the two members of FIG. 1.
Figure 1C:
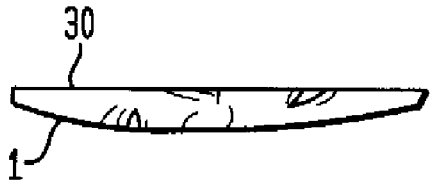
FIG. 1C is side elevational view of one of the members of FIG. 1.
Figure 1D:
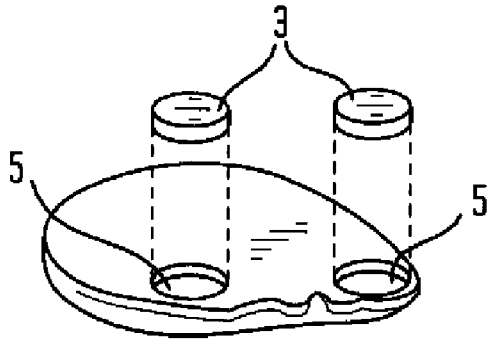
FIG. 1D is a perspective view of the reverse side of one of the members in FIG. 1 with the magnets in an exploded view.
Figure 1E:
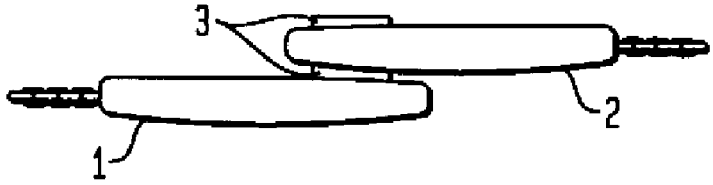
FIG. 1E is a top view of the device of FIG. 1.

FIG. 1B shows the same embodiment from the reverse side 30 with the magnets 3 visible in the recesses 5. In FIG. 1C, one of the members 1, 2 in FIG. 1 is seen from an elevational side view showing the three-dimensional sculptural aspects of the device and in FIG. 1D, the member 1 of the device is shown in perspective view of the reverse side with the recesses 5 for the magnets 3 and the magnets 3 are shown in exploded view. FIG. 1E shows the device of FIG. 1 from a top view where the two members 1, 2 are overlapping and the magnetic connection 3 is also seen.

Figure 2:
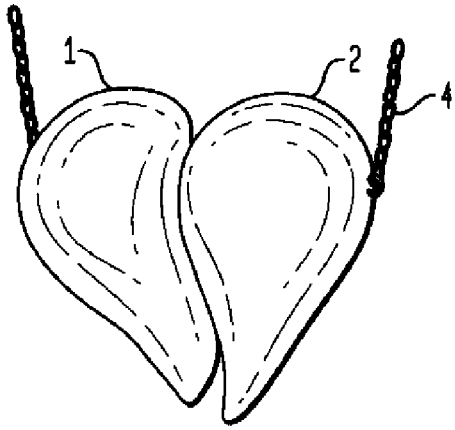
FIG. 2 is a front (obverse) view of another example of the jewelry device.

FIG. 2 shows another embodiment of the device where the two members are connected side-by-side. Also shown is a neck- or bracelet-chain 4 attached to each of the members 1, 2.

Figure 2A:
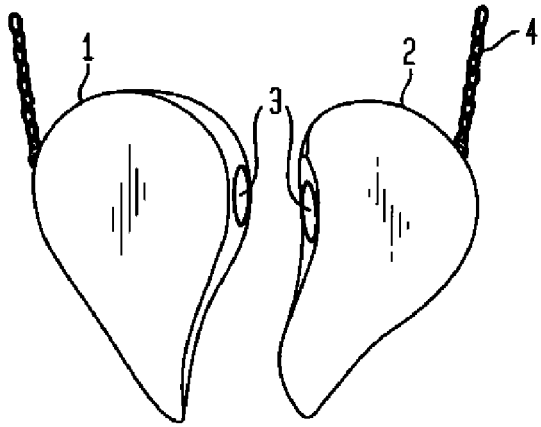
FIG. 2A is a front view of the device in FIG. 2 with the two members shown apart.
Figure 2B:
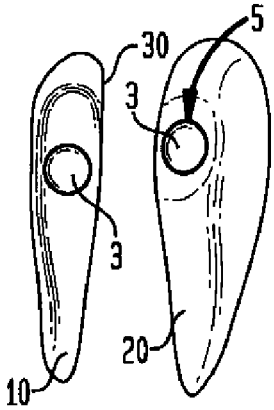
FIG. 2B is a perspective view of the device in FIG. 2A showing the side walls of the complementary portion.

FIG. 2A shows the two members 1, 2 apart and the magnet 3 connection slightly visible. In FIG. 2B, the side walls 10 and 20 of the complementary portion of the two members are shown with the recesses 5. Magnets 3 are firmly attached in each one of the recesses 5. The attachment for the magnet in the recess can be a glue attachment but any other attachment including a frictional attachment which will hold the magnet firmly in place will be suitable.

Figure 3:
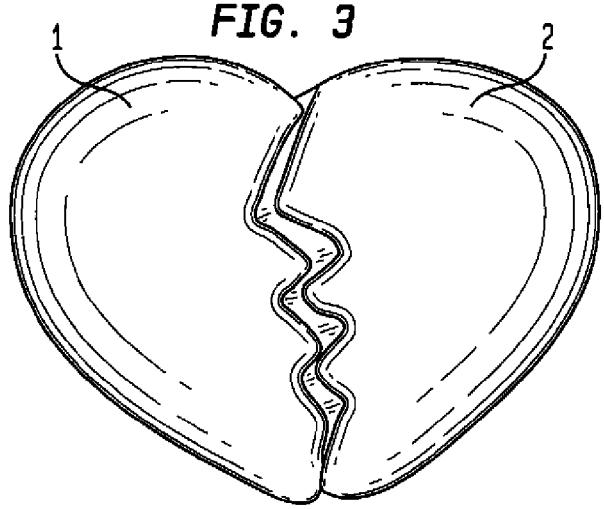
FIG. 3. is a front (obverse) view of yet another example of the jewelry device.
Figure 3A:
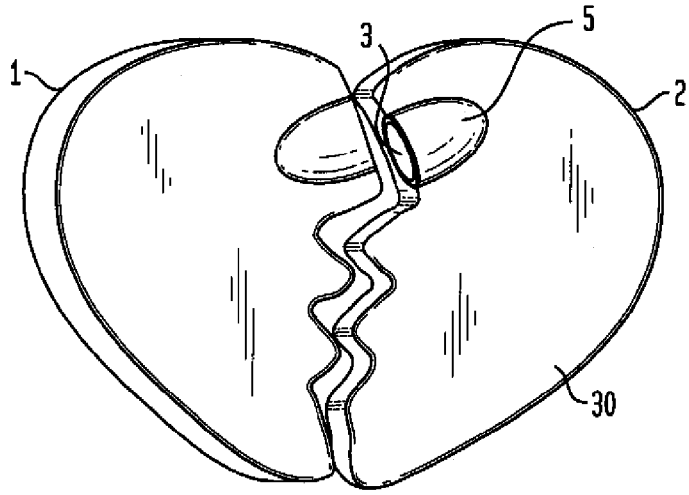
FIG. 3A is a view from the reverse side of the embodiment of FIG. 3.
Figure 3B:
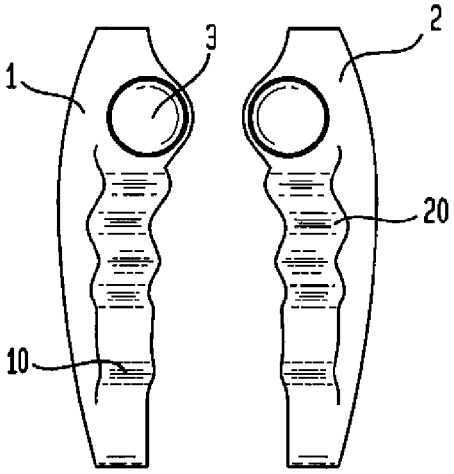
FIG. 3B is a view of the side wall in the embodiment in FIG. 3A with the magnets.
Figure 3C:
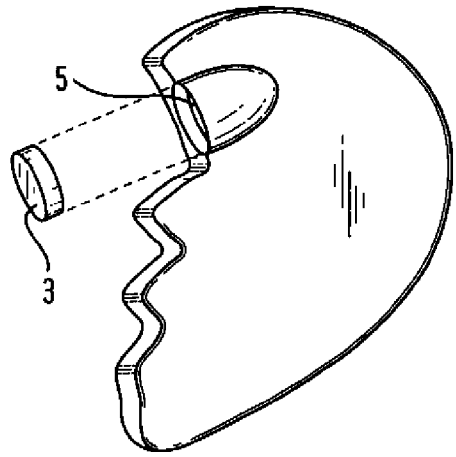
FIG. 3C is a view from the reverse side with the magnet in an exploded view.

FIG. 3 shows another variation of the device where the two members 1, 2 are connected side-by-side and the side walls 10, 20 are in complementary zigzag shapes as shown in FIG. 3B. FIG. 3A show the reverse side 30 of the device in FIG. 3 with the recesses 5 in the form of pockets extending outwardly from the otherwise flat reverse side 30. This particular recess 5 arrangement is more clearly shown in FIG. 3*b*. FIG. 3*c* shows the magnet 3 for the recess 5 in an exploded view.

Figure 4A:
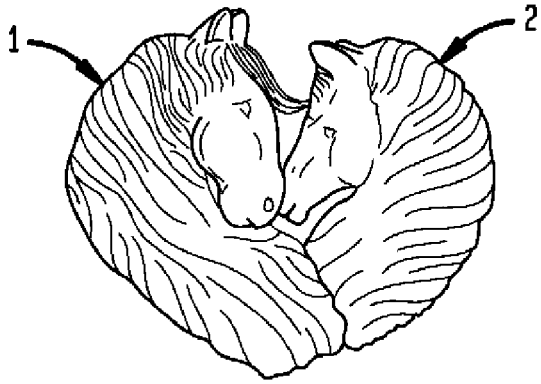
FIG. 4A shows the obverse side of yet another example of the jewelry device.
Figure 4B:
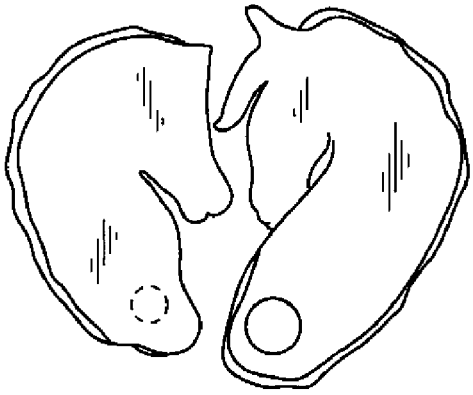
FIG. 4B shows the reverse side of FIG. 4A.
Figure 4C:
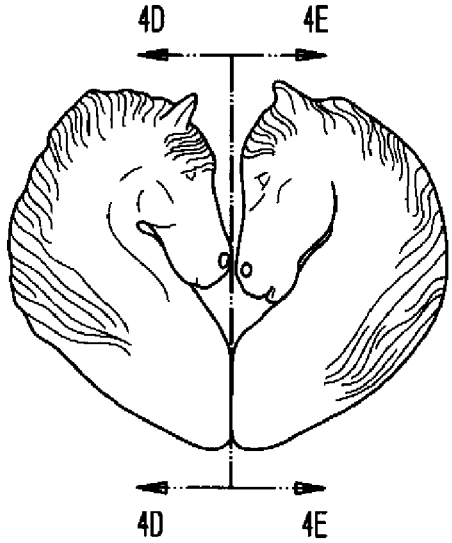
FIG. 4C shows the obverse side of the different design of the device.
Figure 4D:
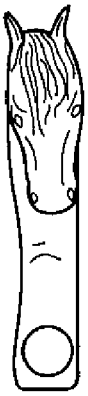
FIG. 4D shows the side wall of the embodiment of FIG. 4C.
Figure 4E:
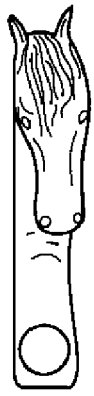
FIG. 4E shows the side wall of the right member of FIG. 4C.
Figure 5A:
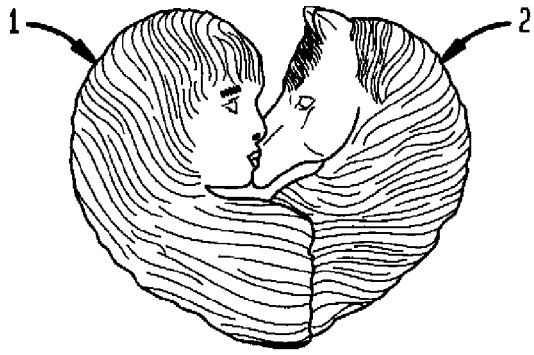
FIG. 5A shows the obverse side of yet another design of the jewelry device.
Figure 5B:
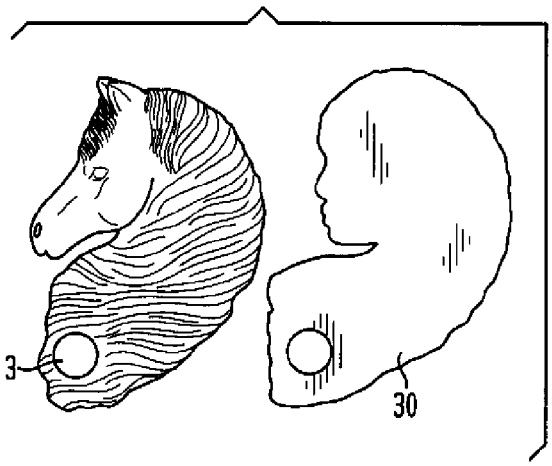
FIG. 5B shows the members of FIG. 5*a* with magnets.
Figure 5C:
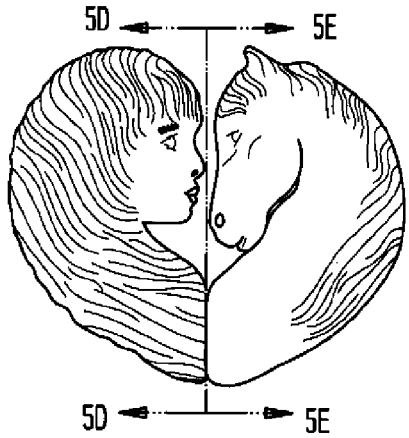
FIG. 5C shows another example of a design of the device.
Figure 5D:
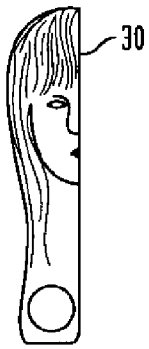
FIGS. 5D and 5E shows the respective side wall views of the members of FIG. 5C.
Figure 5E:
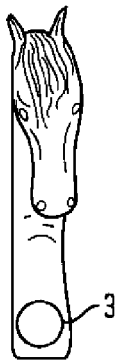

In FIGS. 4A-E and 5A-E are shown different designs that can work with the device and respectively shows the obverse side of a device sculpted with heads of horses and a horse and the head of a girl. FIGS. 4B, D and E and 5B, D and E show the reverse side and/or the placement of the magnets respectively.

Figure 6:
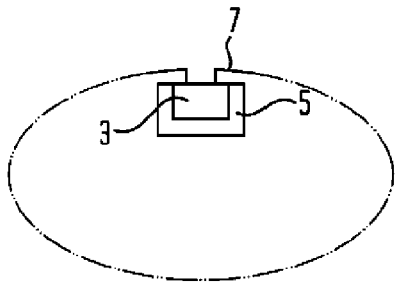
FIG. 6 shows an example of a recess with a "floating" magnet therein.

In FIG. 6, a "floating" magnet 3 is seen in a recess 5 with a collar 7 at the mouth of the recess preventing the magnet 3 to escape from the recess 5 or pocket.

Figure 7A:
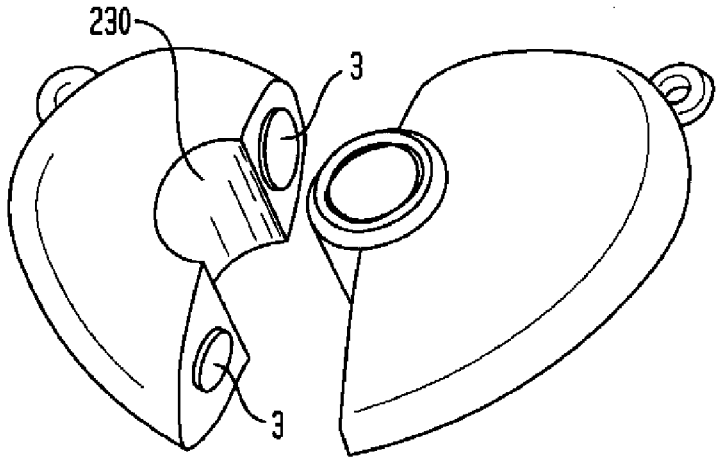
FIG. 7A-C shows an example of the pin and hole system in an open and closed position.
Figure 7B:
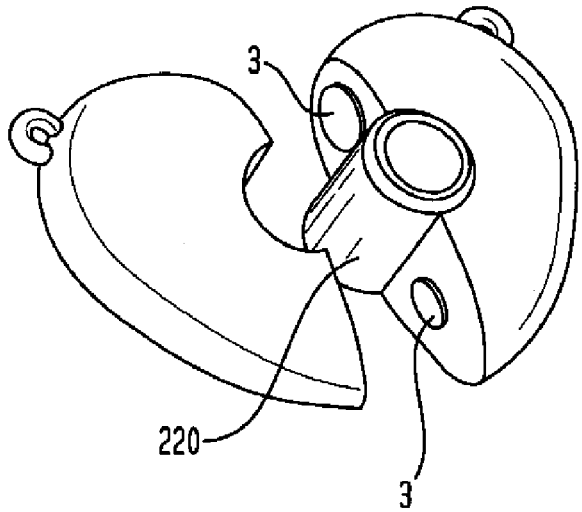
Figure 7C:
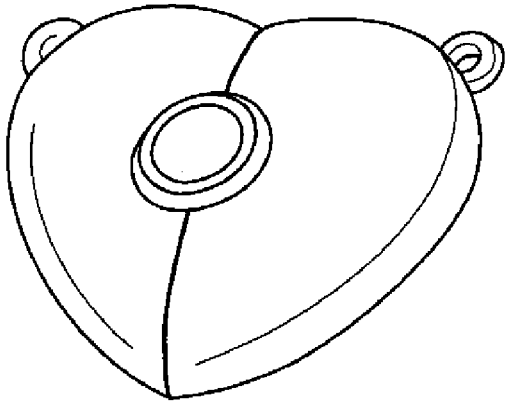

In FIG. 7A-C an example of the pin and hole system in an open and closed position seen in addition to the magnets. The pin 90 is received in the corresponding hole 100 when the magnets are connected. In addition the "tongue" and "groove" system is also seen. In FIGS. 7A and B, where the tongue 220 is shown extending across the entire thickness of the member 1 and the groove 230 is likewise extending across the entire thickness of the corresponding member 2. The medallion is shown in closed position in FIG. 7C and the closures invisible. The medallion here is shown in the form of a pendant.

Figure 8A:
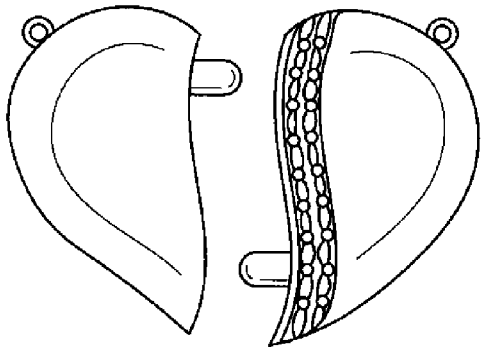
FIG. 8A-B shows a front elevational view of a split jewelry device with the additional pin and hole system.
Figure 8B:
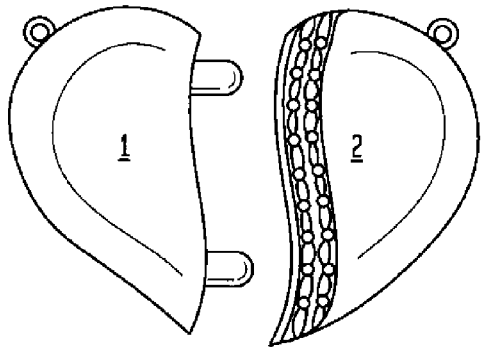
Figure 8C:
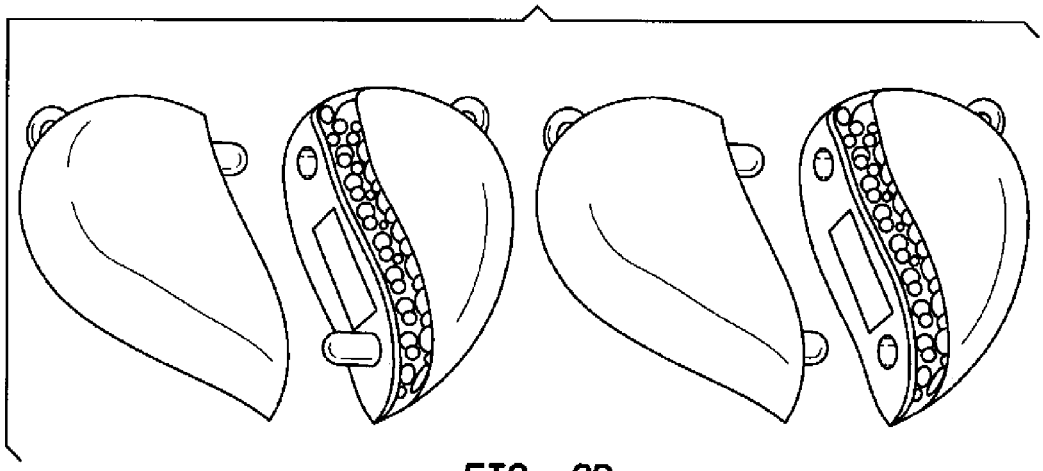
FIG. 8C-D shows a right and left perspective view of the additional pin and hole system in two variations as in FIG. 8*a-b*.
Figure 8D:
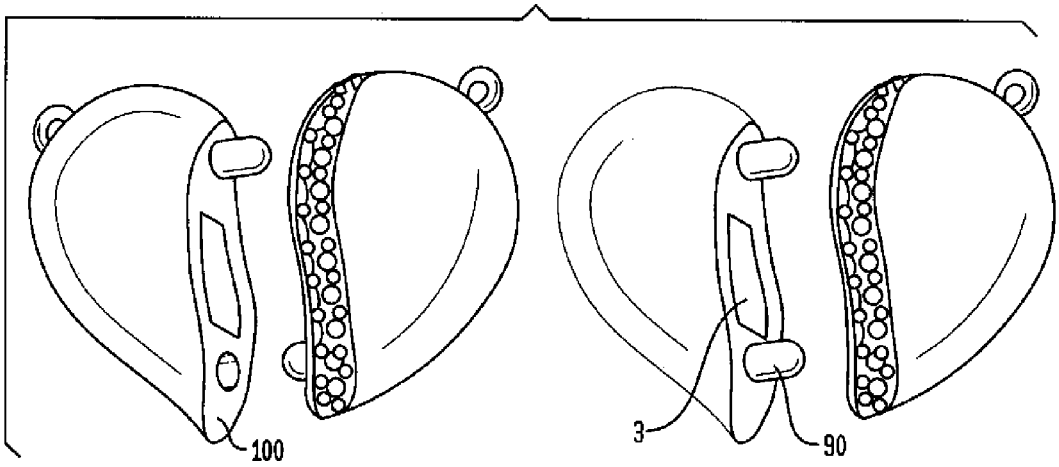

In FIGS. 8A-B the front view of a piece of the jewelry device in the shape of a heart is seen with the pin and hole system and FIGS. 8C-D shows an example of the pin and hole system in a perspective view in open position where in one instance each side wall has a pin 90 and a hole 100 and in the other variation, one side wall has the pins 90 and the complementary side wall has the holes 100. The magnet 3 is arranged in the center between the pin of pins and/or hole or holes.

Figure 9A:
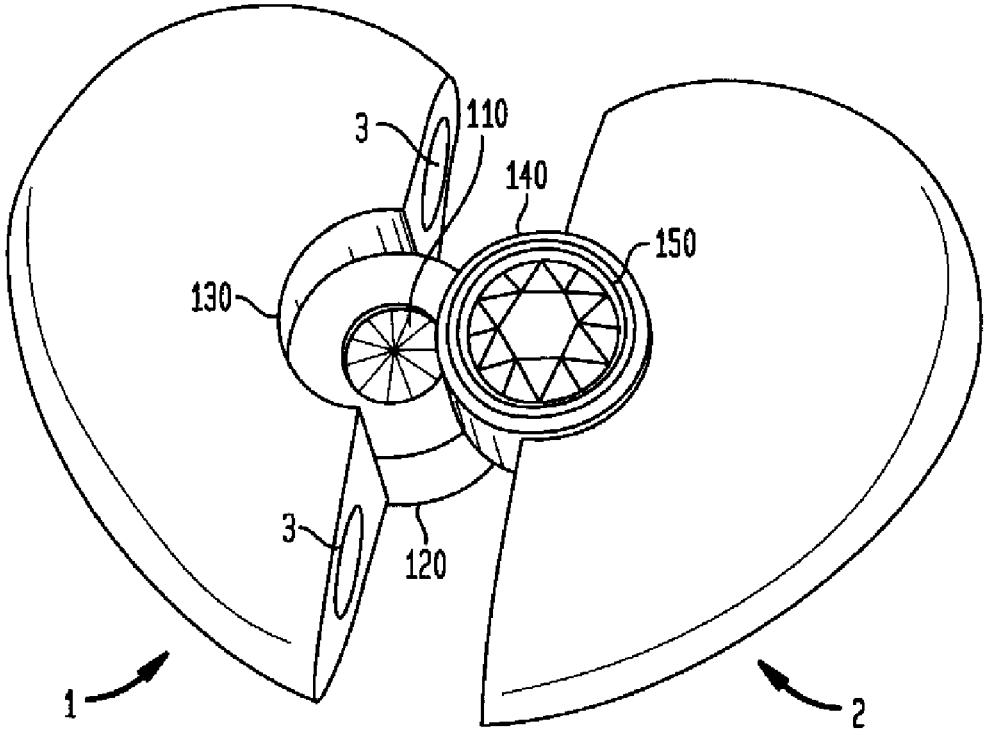
FIG. 9A-B shows a left, right and center perspective view of a variation of the pin and hole system.
Figure 9B:
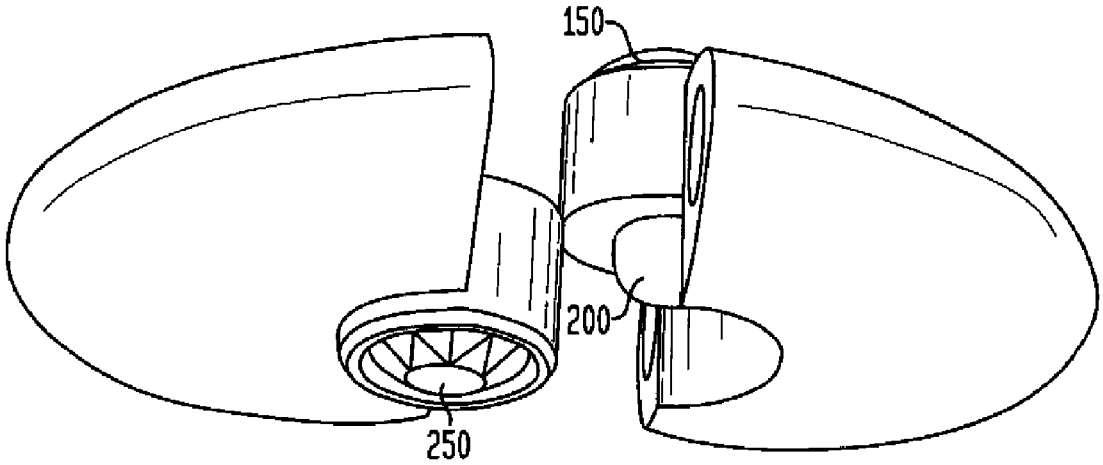

FIGS. 9A-B shows a piece of jewelry in another embodiment of the split medallion where the center axis of the pin and hole closure system is arranged perpendicular to the vertical axis of the magnetic connection or, as shown here from front to back. Accordingly, the magnetic connection is along the vertical axis of the medallion, the pin and hole system connects the members 1 and 2 front to back or in a variation from back to front in an axis perpendicular to the vertical axis As shown in FIG. 9A, member 1 has a semicircular groove 130 and a semicircular projection 120 and provided with an annular opening 110 into which pin 200 of the corresponding member fits. In FIG. 9B the medallion is seen from the reverse. Also seen in FIG. 9A is each of the projections 120 and 140 are one half the thickness of the jewelry members so that when the split medallion is closed the projections form the same thickness of the jewelry piece. As seen in FIG. 9B, the projection 140 is provided with a front face 150 protruding slightly from the jewelry and decorated with a gem stone 250.

Figure 10A:
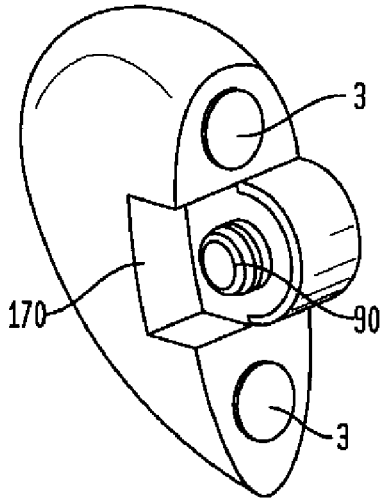
FIG. 10A-B shows a perspective view of another variation of the of the pin and hole/magnetic system.
Figure 10B:
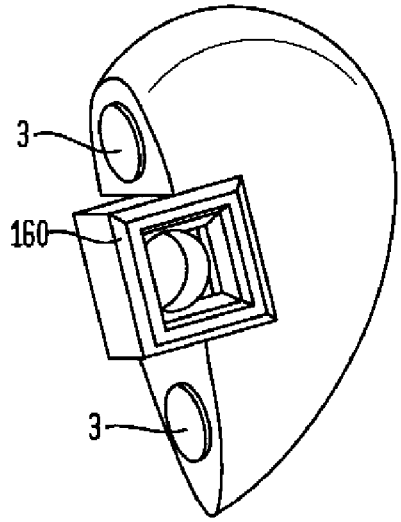

A variation of the pin and hole system is seen in FIG. 10A-10B. In this variant the projection 160 extends as a quadrilateral shape from one of the members, which matches the quadrilateral recess 170, which receives the projection 160. The shape of the projection and the recess 170 can be dictated by the decoration on the front face 150 of the projection. It can thus have any desired shape.

Figure 11A:
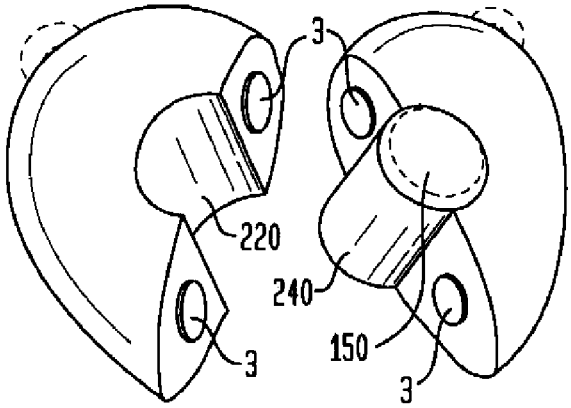
FIG. 11A shows a front/inside perspective view of each member of a heart split medallion showing the "tongue and groove" system.
Figure 11B:
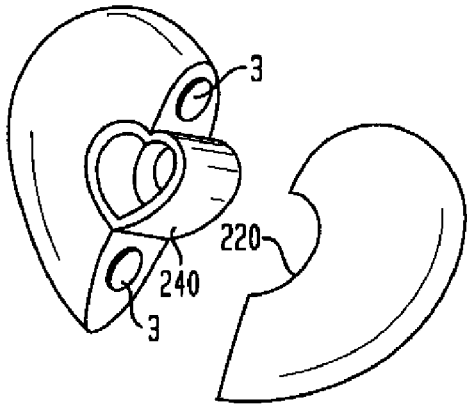
FIG. 11B shows a semi perspective view of a variation of the tongue and groove system.

A simplified but very effective connection between the two members is accomplished by the "tongue and groove" connection in addition to the magnetic connection. As seen in FIG. 11A when the two members connect such that the "tongue" 240 is received in "groove" 220, then, together with the magnetic connection, the connection is sufficiently firm and does not open even under pressure placed on the top of vertical split line. This embodiment is also especially suitable for use of a medallion made from precious or semiprecious stones and the front face 150 can be decorated in any desired way. FIG. 11B shows the "tongue and groove" version where the "tongue" 240 has semi-heart shape for being received in a correspondingly shaped groove 220.

Figure 12:
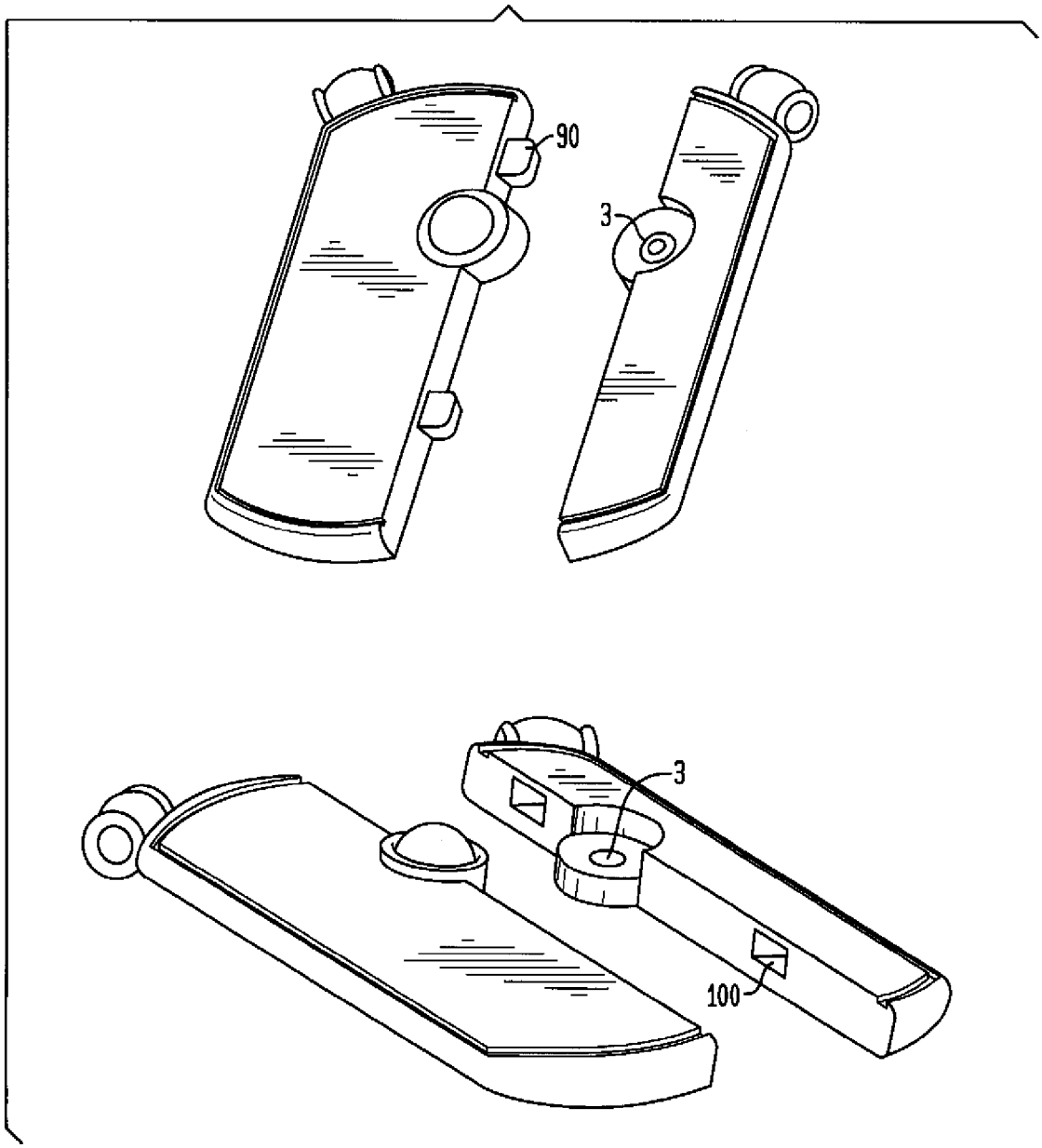
FIG. 12. shows a front/inside perspective view of a variation of the pin and hole system together with the magnetic connection

FIG. 12 shows another variation of the connection of the members, where the connection between the pin and hole occurs along the vertical axis and the magnetic connection goes perpendicular to that. The respective projection with the magnet takes up half the thickness of the piece of jewelry. The "pins" 90 are shown here as square shaped for being received in the correspondingly shaped square hole 100.

Figure 13A:
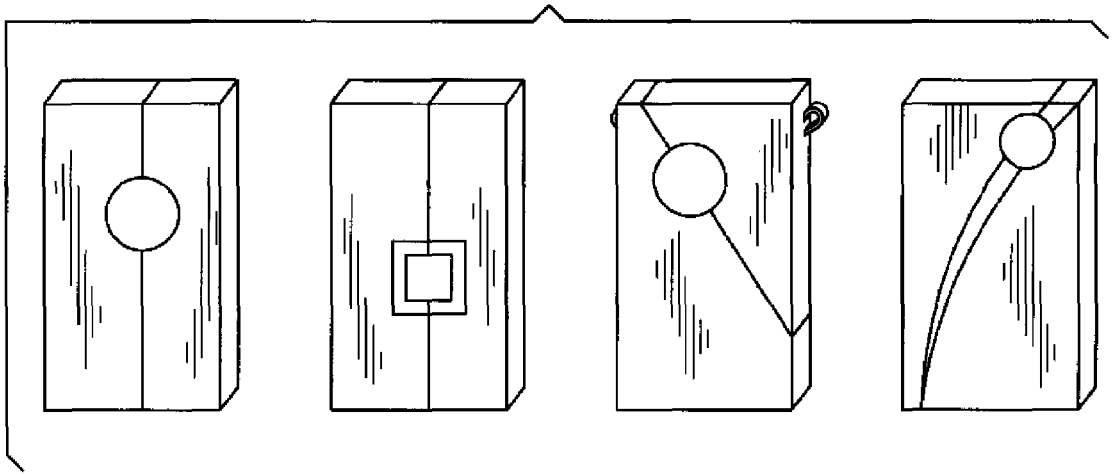
FIG. 13A-B shows the front views of variations of a pendant with the closure axis off center and inside connection.
Figure 13B:
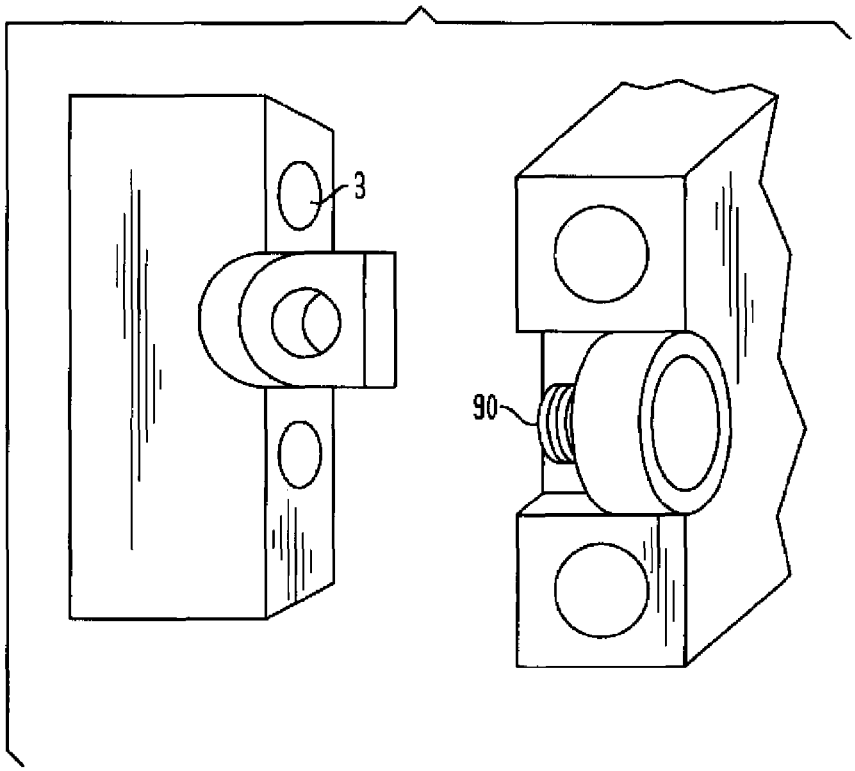

In FIG. 13A the jewelry pieces are shown where the axis A of closure, while substantially vertical can also be off center or curving. In the view 13B the inside connection is seen as a pin and hole system together with a magnetic connection.

Figure 14:
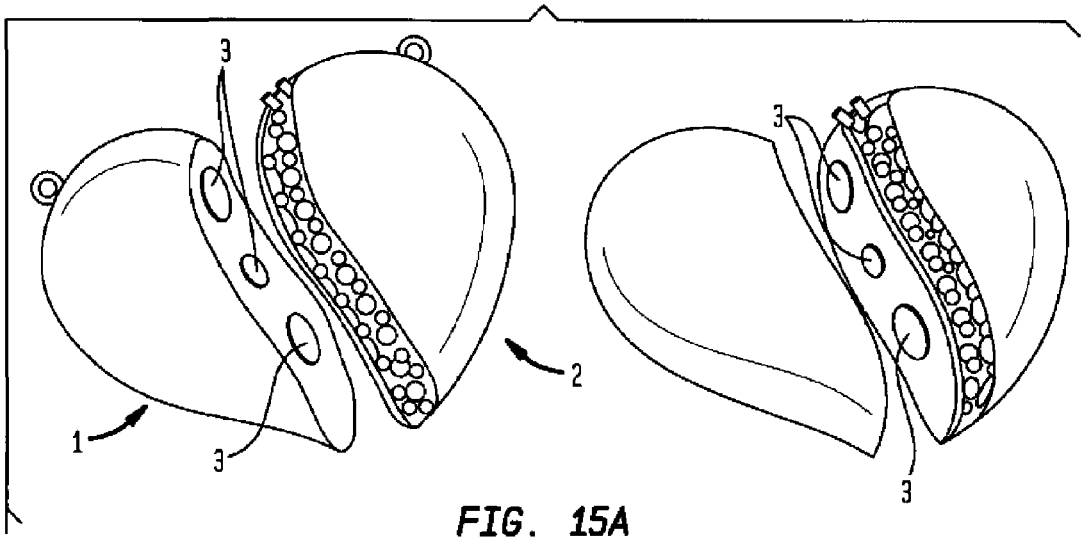
FIG. 14 shows a piece of jewelry with magnetic connection.

In FIG. 14, the split medallion is shown with only the magnetic connection. Each member 1, 2 of the medallion connects side by side with the other member and along a substantially vertical axis. As hung from the wearer's neck the side by side connection is suitably strong. The side wall 300 is shown as part of the complementary portion of the members 1, 2.

Figure 15A:
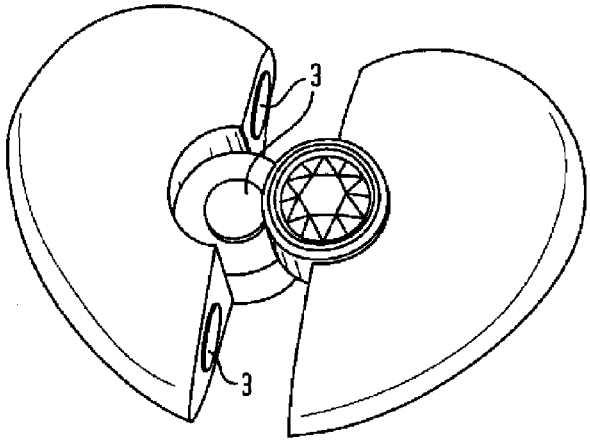
FIG. 15A-B shows a variation of the piece of jewelry of 9B without the pin but a magnet
Figure 15B:
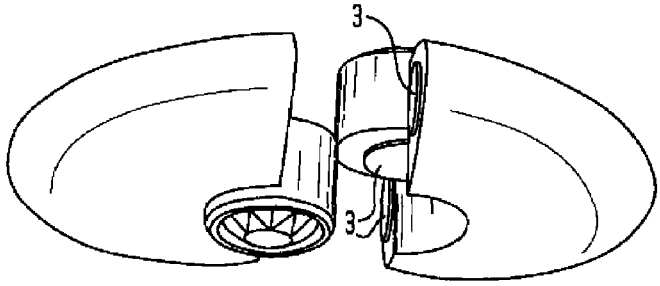

In FIGS. 15A and B another variation of the split medallion is a double magnet connection shown in 15A from front to back, and 15B from back to front, and where the first magnetic connection is at the vertical axis (side by side) and at the same time, the second magnetic connection is in an axis perpendicular to the first connection (front to back or back to front).

Figure 16A:
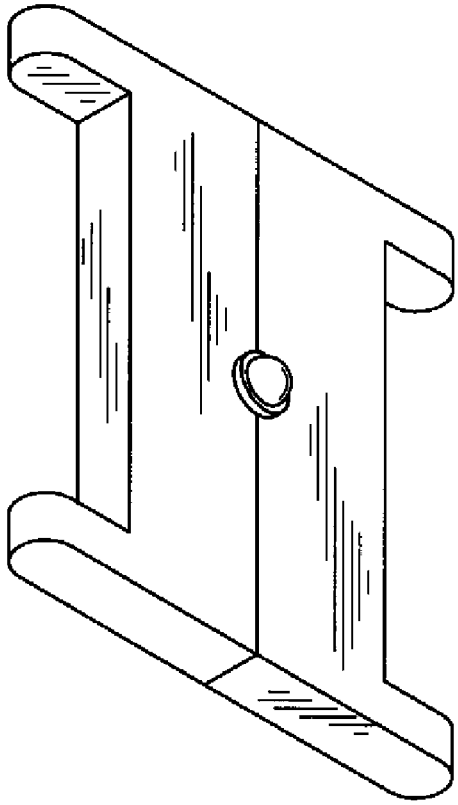
FIG. 16A-B shows a variation of the piece of jewelry for use as a bracelet, watchband or a belt.
Figure 16B:
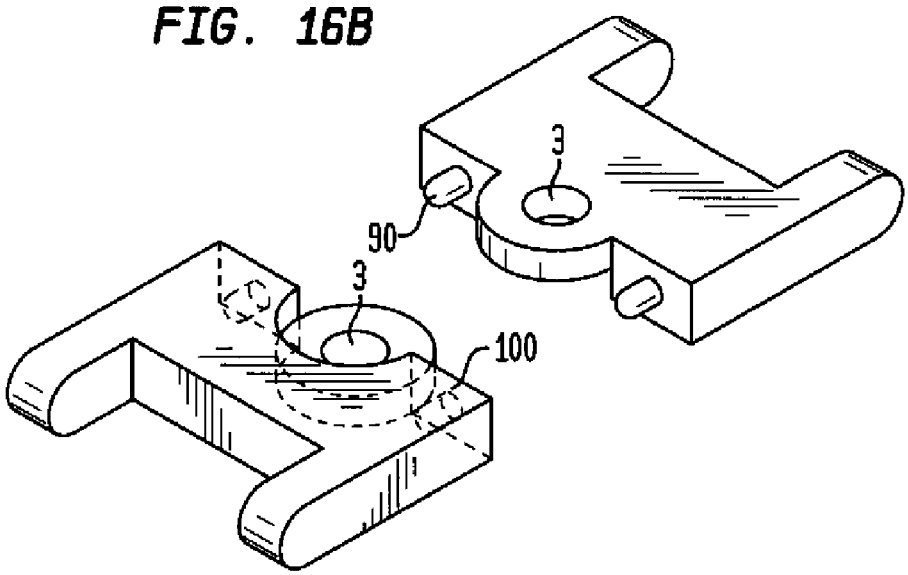

FIG. 16A shows a split medallion where each of the members has outer brackets for attachment to a belt a wristband or similar. The connection between the two pieces is seen in FIG. 16B to be a pin hole and a magnetic connection.

While the invention has been illustrated and described as embodied in an interconnected split medallion jewelry device, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. An interconnected split medallion comprising:

two members connected at a vertical parting plane, each member having a planar surface extending parallel to and along said parting plane at each end and above and below a central projection; and first and second connecting means; wherein the first connecting means are positioned at said planar surface and the second connecting means are positioned at the said central projection, wherein the first connecting means are attached to each other in one plane, and the second connecting means are attached to each other at a plane perpendicular to the first plane when the two members are combined, and wherein the first and second connecting means are magnets.

2. The interconnected split medallion of claim 1, wherein the two connected members form a pendant.

3. The interconnected split medallion of claim 1, wherein the split medallion is made from one or more materials selected from the group consisting of metal, precious metal, stone and gemstone.

4. The interconnected split medallion of claim 1, wherein the two members are connected along a diagonal parting plane.

5. The interconnected split medallion of claim 4, wherein the diagonal parting plane is curvilinear.

6. The interconnected split medallion of claim 1, wherein the center portion has a decoration, which is a gem stone.

7. The interconnected split medallion of claim 1, wherein the magnets are fit into recesses.

8. The interconnected split medallion of claim 7, wherein the magnets are covered.

9. The interconnected split medallion of claim 1, wherein the center portion is of a shape selected from the group consisting of semicircular, oval, heart-shaped, quadrilateral, hexagonal and triangular.

10. The interconnected split medallion of claim 1, wherein the center portion has a surface suitable for decoration.

* * * * *